US006973763B2

(12) United States Patent
Weder

(10) Patent No.: US 6,973,763 B2
(45) Date of Patent: Dec. 13, 2005

(54) APPARATUS FOR FORMING AND SECURING A DECORATIVE PLEATED COVER ABOUT A FLOWER POT

(75) Inventor: Donald E. Weder, Highland, IL (US)

(73) Assignee: Wanda M. Weder and William F. Straeter, Trustees of The Family Trust, Highland, IL (US)

( * ) Notice: Subject to any disclaimer, the term of this patent is extended or adjusted under 35 U.S.C. 154(b) by 0 days.

(21) Appl. No.: 10/627,123

(22) Filed: Jul. 25, 2003

(65) Prior Publication Data

US 2005/0016136 A1 Jan. 27, 2005

(51) Int. Cl.[7] ..... B65B 67/00; B65B 67/08

(52) U.S. Cl. ..... 53/399; 53/221; 53/390; 53/580

(58) Field of Search ..... 53/221, 390, 399, 53/580, 585

(56) References Cited

U.S. PATENT DOCUMENTS 3,974,762 A 8/1976 Kita et al.
5,073,161 A * 12/1991 Weder et al. ..... 493/154
5,105,599 A 4/1992 Weder
5,249,407 A * 10/1993 Stuck ..... 53/399
5,632,131 A * 5/1997 Weder et al. ..... 53/399
5,740,656 A 4/1998 Weder et al.
5,839,256 A 11/1998 Weder et al.
5,921,060 A * 7/1999 Straeter ..... 53/176
5,927,045 A * 7/1999 Weder et al. ..... 53/218
6,178,727 B1 * 1/2001 Weder et al. ..... 53/580
6,647,695 B2 * 11/2003 Weder ..... 53/397
6,718,741 B1 * 4/2004 Weder et al. ..... 53/592
2003/0167734 A1 * 9/2003 Grether ..... 53/399
2004/0025469 A1 * 2/2004 Scaliti et al. ..... 53/138.1

* cited by examiner

*Primary Examiner*—Scott A. Smith
*Assistant Examiner*—Gloria R. Weeks
(74) *Attorney, Agent, or Firm*—Dunlap, Codding & Rogers, P.C.

(57) ABSTRACT

An apparatus for forming a decorative pleated cover about an outer peripheral surface of a flower pot. The apparatus includes a frame assembly, a platform adjustably connected to the frame assembly, a pleating assembly supported on the platform and a banding assembly also connected to the platform. The banding assembly is disposed about the pleating assembly and supports at least one band so that upon forming a decorative pleated cover about the flower pot with the pleating assembly, the decorative pleated cover so formed is secured about the flower pot with a band while the flower pot having the decorative pleated cover formed thereabout is supported within the pleating assembly.

8 Claims, 7 Drawing Sheets

APPARATUS FOR FORMING AND SECURING A DECORATIVE PLEATED COVER ABOUT A FLOWER POT

FIELD OF THE INVENTION

The present invention relates generally to a method and apparatus for forming a decorative cover generally about an outer peripheral surface of a flower pot and applying a band about the decorative cover for securing same about the flower pot. In one aspect, the present invention relates generally to a method and apparatus for forming a decorative pleated cover about an outer peripheral surface of a flower pot, and utilizing a banding assembly for securing the decorative pleated cover about the outer peripheral surface of the flower pot.

DESCRIPTION OF PREFERRED EMBODIMENTS

Figure 1:
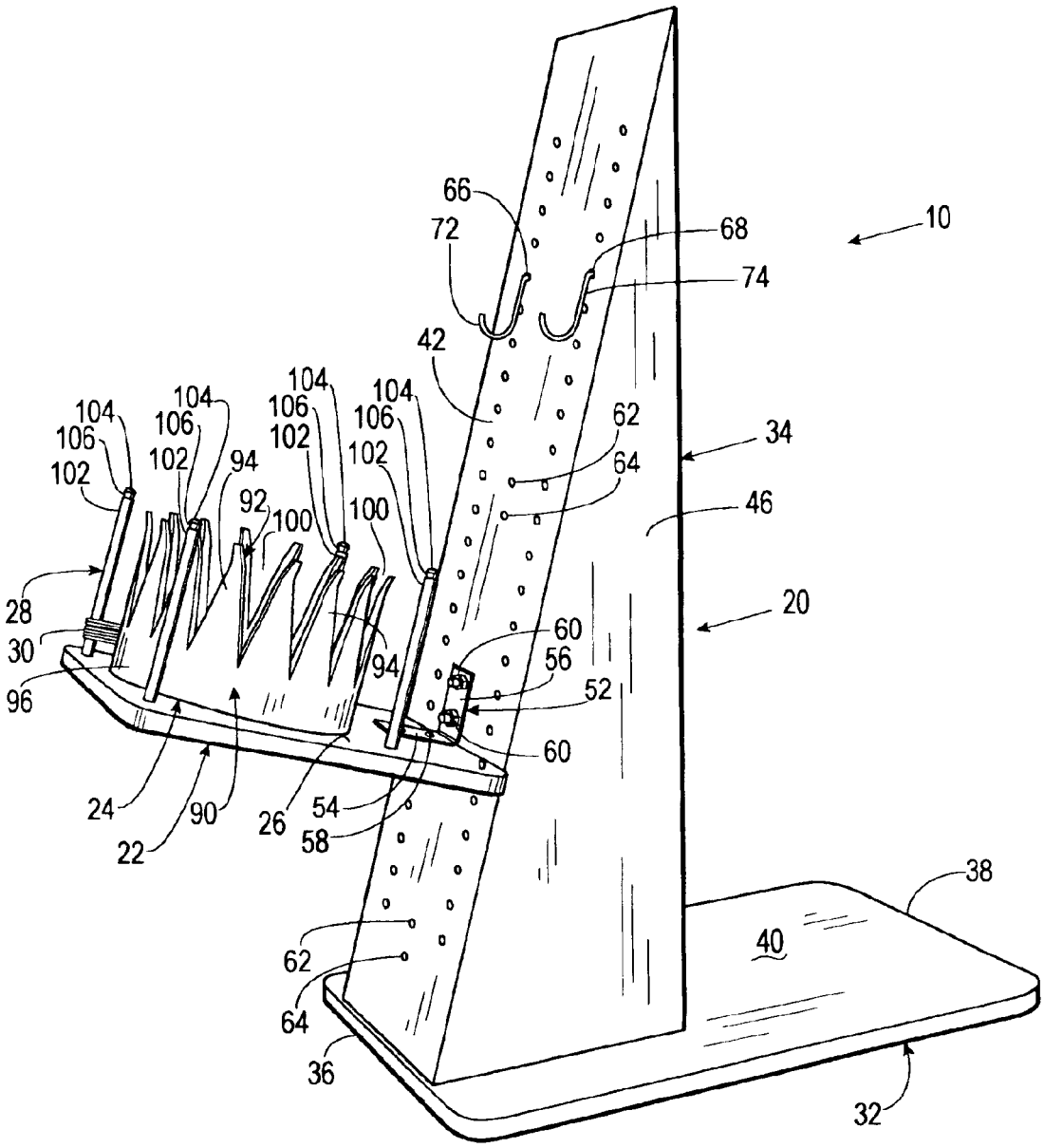
FIG. 1 is a perspective view of an apparatus for forming and securing a decorative pleated cover about an outer peripheral surface of a flower pot constructed in accordance with the present invention.
Figure 2:
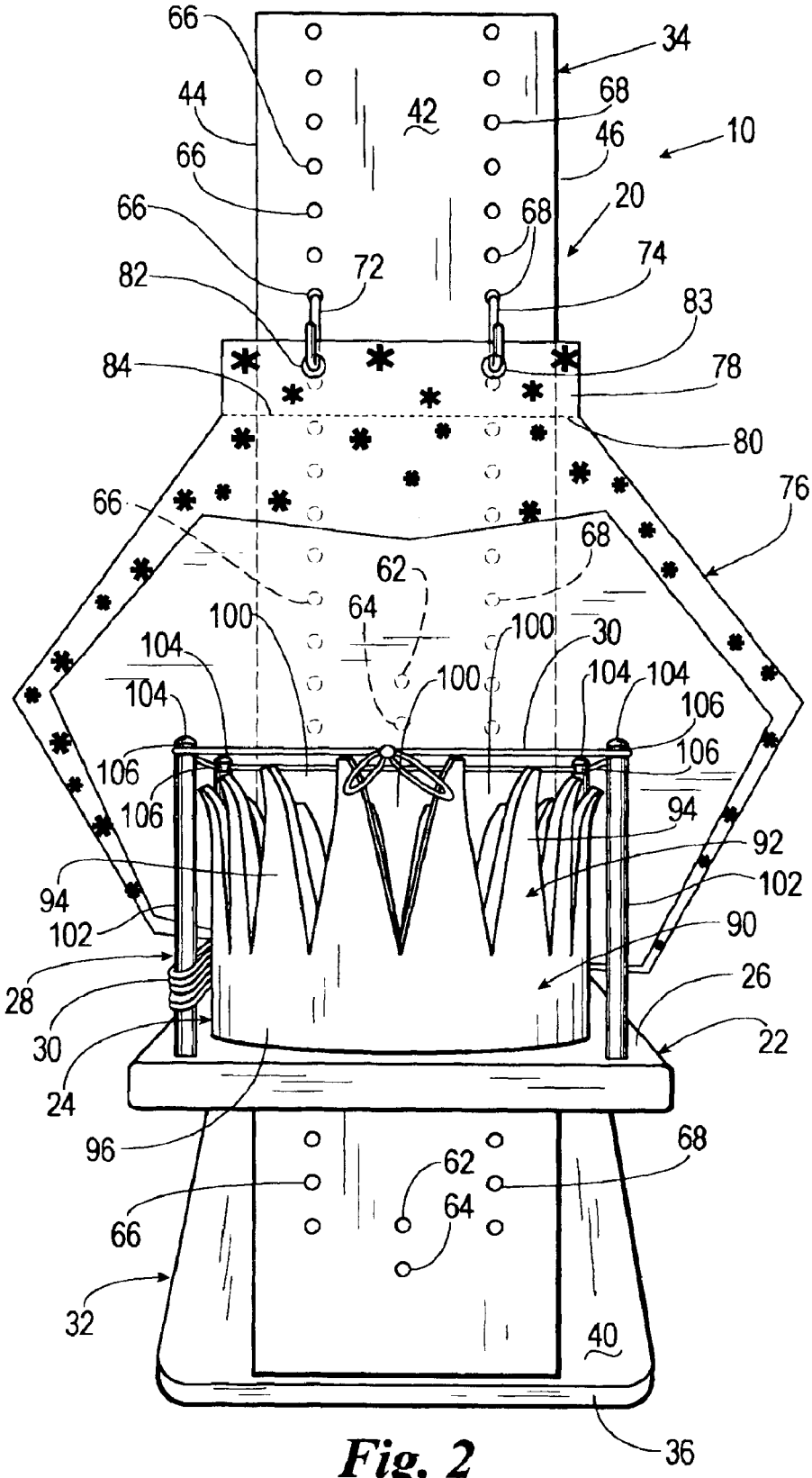
FIG. 2 is a frontal perspective view of the apparatus of FIG. 1 having a cover forming material supported in a stored position on a frame of the apparatus and having a plurality of bands supported on a banding assembly of the apparatus.
Figure 4:
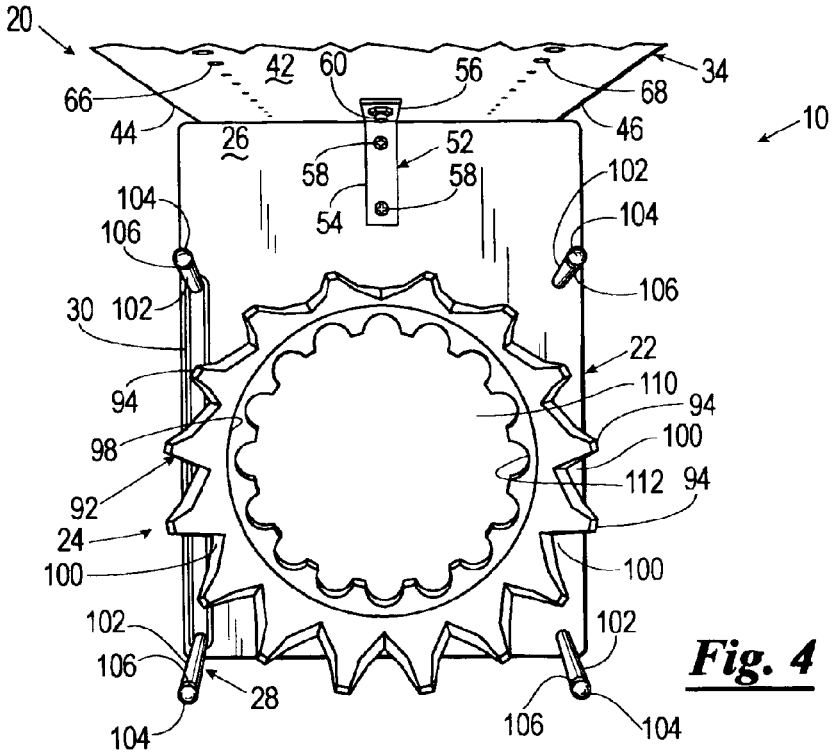
FIG. 4 is a top perspective view of a platform connected to the frame assembly, the platform having a pleating assembly supported on an upper surface of the platform.
Figure 9:
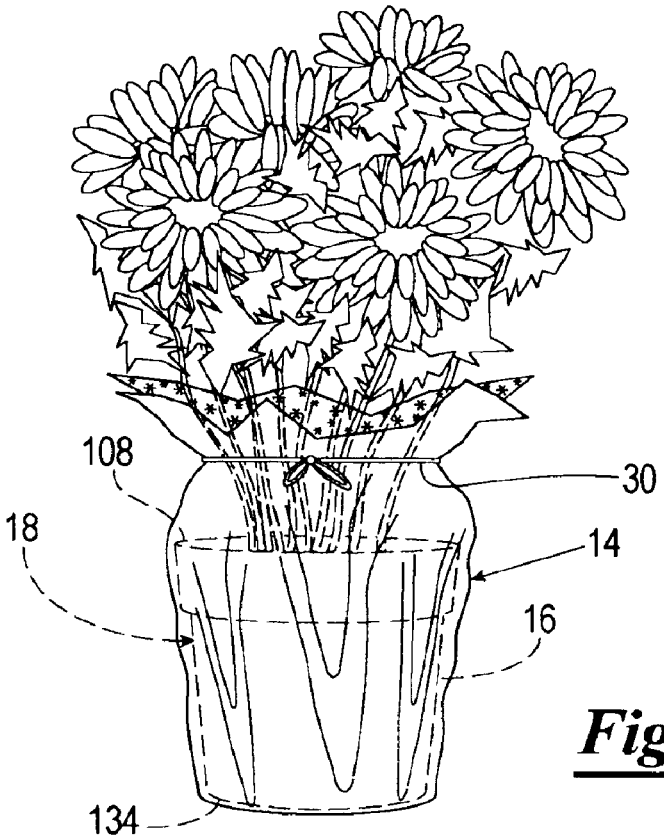
FIG. 9 is a perspective view of the decorative pleated cover disposed about the outer peripheral surface of the flower pot wherein the decorative pleated cover is secured about the flower pot by a band disposed above an upper rim of the flower pot.
Figure 10:
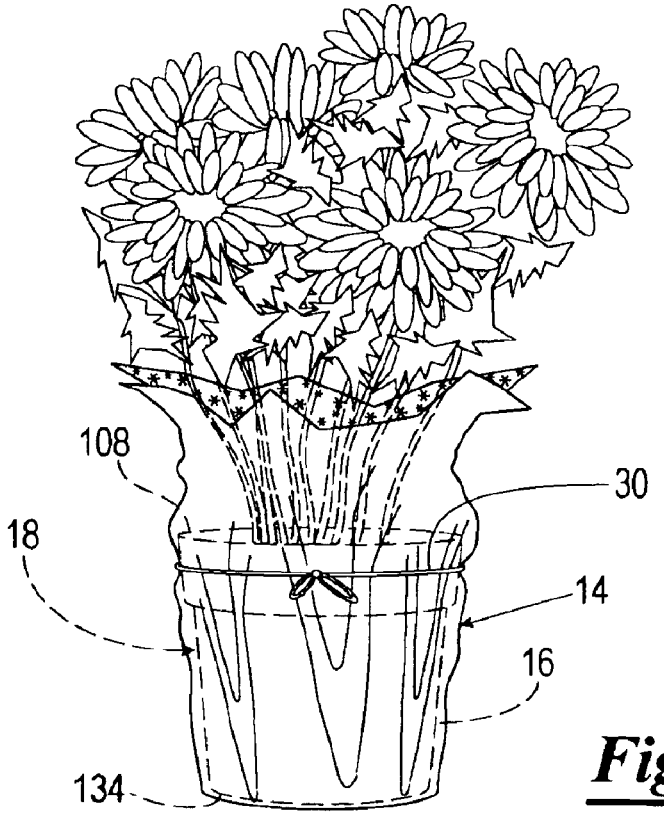
FIG. 10 is a perspective view of the decorative pleated cover disposed about the outer peripheral surface of the flower pot wherein the decorative pleated cover is secured about the flower pot by a band disposed below the upper rim of the flower pot.

Referring now to the drawings, and more particularly to FIGS. 1, 2 and 4, shown therein and designated by the general reference number 10 is an apparatus for forming and securing a decorative pleated cover 14 about an outer peripheral surface 16 of a flower pot 18 (FIGS. 9 and 10). The apparatus 10 includes a frame assembly 20 (FIGS. 1 and 2) and a platform 22 connected to the frame assembly 20 such that the platform 22 extends outwardly from the frame assembly 20. A pleating assembly 24 is supported on an upper surface 26 of the platform 22 such that the pleating assembly 24 extends upwardly from the upper surface 26 of the platform 22.

A banding assembly 28 is also connected to the upper surface 26 of the platform 22 so that the banding assembly 28 is disposed about the pleating assembly 24. The banding assembly 28 supports at least one band 30 thereon such that upon forming the decorative pleated cover 14 about the outer peripheral surface 16 of the flower pot 18, as will be described in more detail herein after, the decorative pleated cover 14 is secured about the flower pot 18 by at least one band 30 (FIGS. 9 and 10).

Figure 3A:
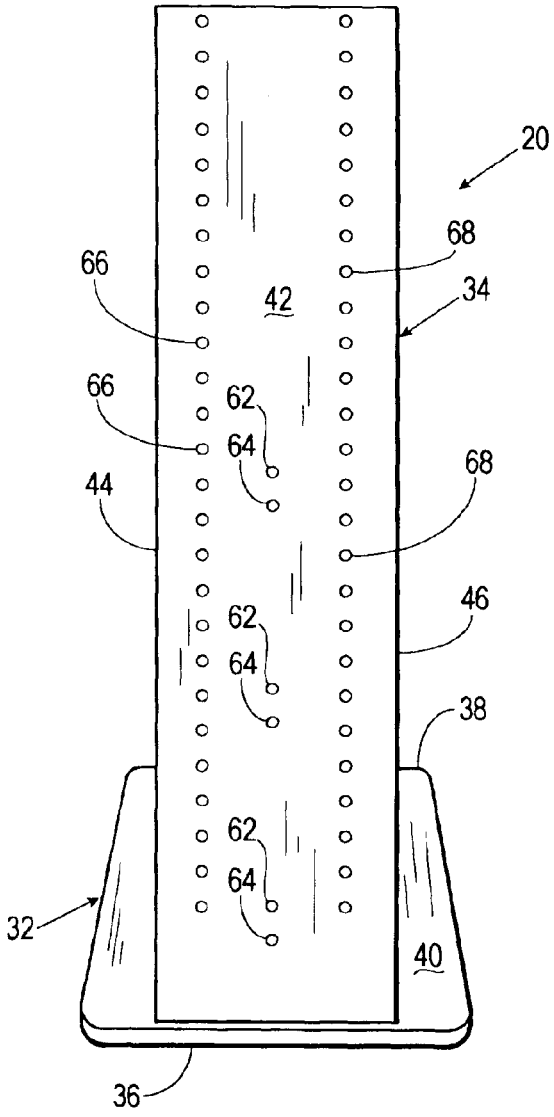
FIG. 3A is a frontal perspective view of a frame assembly of the apparatus of the present invention.
Figure 3B:
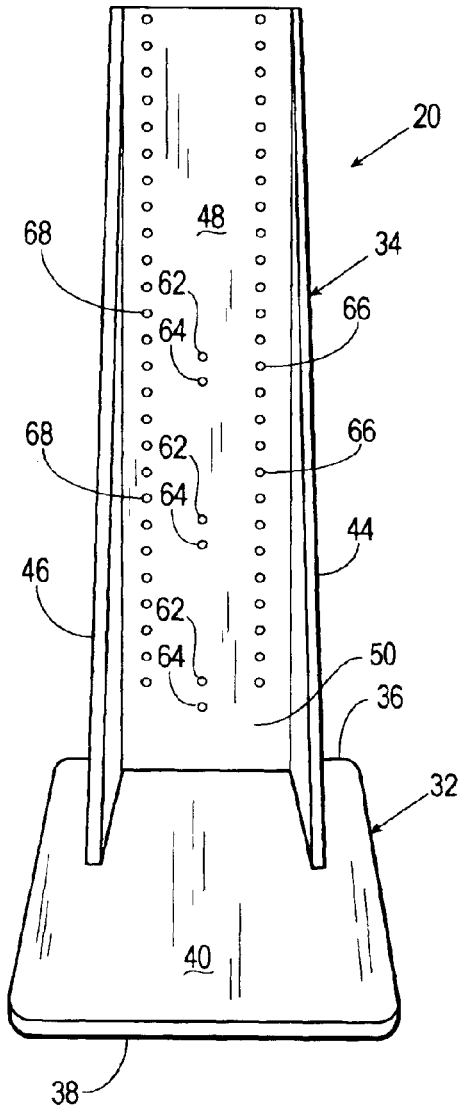
FIG. 3B is a rear perspective view of the frame assembly of FIG. 3A.

Referring now to FIGS. 1 and 2, in combination with FIGS. 3A and 3B, the frame assembly 20 is provided with a base 32 and an upright member 34. The base 32 is provide with a first or front end 36, a second or rearward end 38 (FIGS. 3A and 3B) and an upper surface 40. The upright member 34 is supported on the upper surface 40 of the base 32 so as to be disposed near the first or front end 36 of the base 32. However, it should be understood that the upright member 34 may be supported on any portion of the base 32 as long as sufficient stability is provided the apparatus 10 to permit the apparatus 10 to carry out the intended function of forming the decorative pleated cover 14 about the flower pot 18 and thereafter allowing the decorative pleated cover 14 to be secured thereto by application of the band 30.

The upright member 34 is provided with a front side 42 (FIG. 3A), a first side 44, a second side 46 and a back side 48 (FIG. 3B). The first and second side 44, 46 of the upright member 34 are spatially disposed and cooperate with the back side 48 of the upright member 34 to define a channel 50 (FIG. 3B) extending along the length of the back side 48 of the upright member 34. The channel 50 formed along the back side 48 of the upright member 34 provides a convenient way to connect the platform 22 to the upright member 34, while also permitting the platform 22 to be positioned at different heights on the upright member 34 as will be described in more detail herein after.

The upright member 34 is shown in FIG. 1 as being angularly disposed towards the second or rearward end 38 of the base 32. However, it should be understood that the upright member 34 may be disposed substantially perpendicular to the upper surface 40 of the base 32, or the upright member 34 may disposed at any angle relative to the base 32 depending on the preference of the user of the apparatus 10, the only requirement being that the upright member 34 be supported on the base 32 in a stable position which facilitates use of the apparatus 10.

As more clearly shown in FIGS. 1 and 4 the platform 22 is connected to the upright member 34 of the frame assembly 20 via a substantially L-shaped bracket 52 having a first leg 54 and a second leg 56. The first leg 54 is provided with a pair of apertures (not shown), each of which is adapted to receive a connecting member 58 for connecting the first leg 54 of the bracket 52 to the platform 22 of the apparatus 10; and the second leg 56 is provided with a plurality of apertures (not shown), each of which is adapted to receive a connecting member 60 for connecting the second leg 56 of the L-shaped bracket 52 to the upright member 34. Thus, the first and second legs 54 and 56 of the substantially L-shaped bracket 52 permit connection of the platform 22 to the upright member 34 in a manner which will be described in more detail herein after.

The connecting members 58 and 60 may be any type of connector capable of securing the L-shaped bracket 52 to the platform 22 and to the upright member 34 so that the platform 22 is connected to the upright member 34. For example, but not by way of limitation, the connecting members 58 and 60 may be screws, nuts and bolts, and combinations thereof.

Referring now to FIGS. 1–3B, the upright member 34 of the frame assembly 20 is provided with a plurality of spatially disposed apertures 62 and 64 formed at predetermined positions along the length of the upright member 34 so as to permit adjustment of the height of the platform 22 relative to the base 32 of the frame assembly 20. The apertures 62 and 64 are substantially centrally disposed on the upright member 34 and positioned such that each pair of apertures 62 and 64 can be aligned with the apertures (not shown) in the second leg 56 of the substantially L-shaped bracket 52. Therefore, upon aligning the apertures (not shown) in the second leg 56 of the substantially L-shaped brackets 52 with selected apertures 62 and 64, and utilizing a pair of the connecting members 58 and 60, the platform 22 can be secured to the upright member 34 at predetermined positions along the length of the upright member 34. Thus, the distance between the platform 22 and the base 32 of the frame assembly 20 can be readily varied to facilitate use of the apparatus 10.

Referring now to FIGS. 1–4, a plurality of apertures 66 are also provided in the upright member 34, the apertures 66 being aligned and extending along at least a portion of the length of the upright member 34 such that the apertures 66 are substantially parallel to and in close proximity to the first side 44 of the upright member 34. Similarly, a plurality of apertures 68 are also provided in the upright member 34, the apertures 68 being aligned and extending along at least a portion of the length of the upright member 34 such that the apertures 68 are substantially parallel to and in close proximity to the second side 46 of the upright member 34. Further, each of the apertures 66 is aligned with one of the apertures 68 substantially as shown. Thus, hooks 72 and 74 can be connected to the upright member 34 via the apertures 66 and 68 substantially as shown in FIGS. 1 and 2. The hooks 72 and 74, which serve as a wicket, are adapted to receive a one or more cover forming materials 76 (FIG. 2) for forming the pleated decorative cover 14 about the outer peripheral surface 16 of the flower pot 18 substantially as shown in FIGS. 9 and 10.

Figure 7:
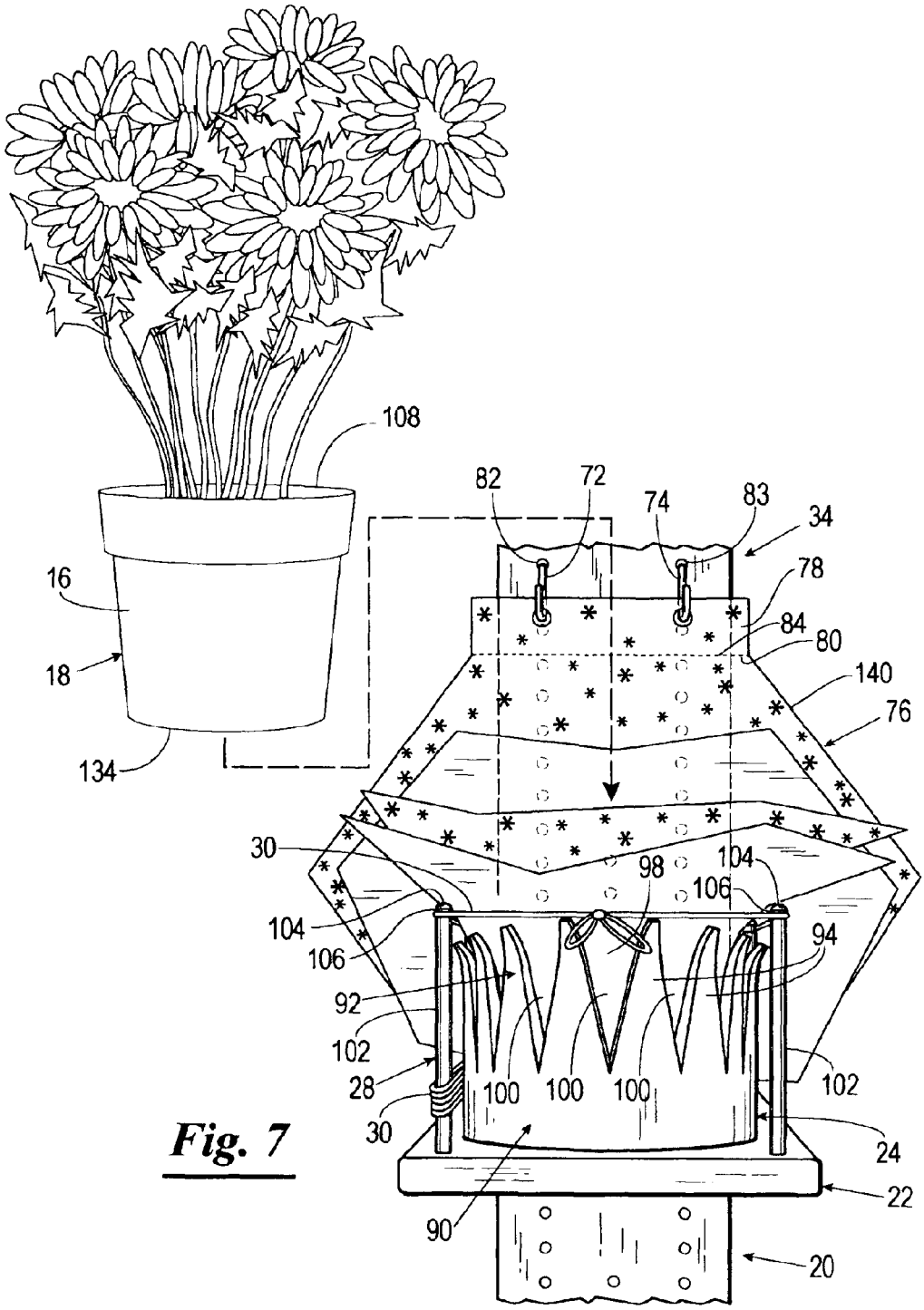
FIG. 7 is a perspective view of a flower pot and a portion of the apparatus of FIG. 1 illustrating the formation of a decorative pleated cover about an outer peripheral surface of a flower pot.

Referring now to FIGS. 2 and 7, the cover forming material 76 is preferably provided with an extension 78 provided along an upper end 80 thereof, and the extension 78 and is provided with apertures 82 and 83 adapted to receive the hooks 72 and 74, respectively. Perforations 84 are desirably provided between the upper end 80 of the cover forming material 76 and the extension 78 so that the extension 78 can be detached from the cover forming material 76 by tearing along the perforations 84, either while the extension 78 remains connected to the upright member 34 of the frame assembly 20 via the hooks 72 and 74, or after the extension 78 and the cover forming material 76 are removed from the hooks 72 and 74. While perforations 84 have been illustrated for enhancing separation of the extension 78 from the cover forming material 76, it should be understood that any type of detaching element can be employed.

The cover forming material 76 which may be used in the practice of the present invention may be one or more floral sleeves, one or more sheets of material, or any other material capable of being formed into the decorative pleated cover 14 extending about the outer peripheral surface 16 of the flower pot 18. In addition, the cover forming material 26 may be provided with extensions (not shown) which provide the cover forming material 26 with an appearance of being formed of or containing a plurality of sleeves, sheets of material, or other material and the extension may be of the same type of material or different types of material than that of the sleeves, sheets of material or other material used to produce the decorative pleated cover 14.

The cover forming material 76 may be constructed from any suitable material that is capable of being formed into the decorative pleated cover 14. For example, the covering forming material 76 may be constructed of paper, foil, cloth (natural or synthetic or combinations thereof), denim, burlap, polymeric film and combinations or lamination thereof.

The term "polymeric film" as used herein is understood to be either a film of a synthetic polymeric material, such as polypropylene film, or a film of a natural occurring polymeric material, such as cellophane.

The thickness of the cover forming material 76 employed in the practice of the present invention can vary widely but will generally be in the range from about 0.1 mil to 30 mil, and more desirably from about 0.1 mil to about 5 mil.

When the cover forming material 76 is a sheet of material, one or more sheets or material, may be employed to form the decorative pleated cover 14. Further, the sheets of material may have any geometric configuration, such as square, rectangle, heart shape, octagonal, combinations thereof and the like. In addition, the cover forming material 76 may be one or more sheets of laminated material.

Figure 8:
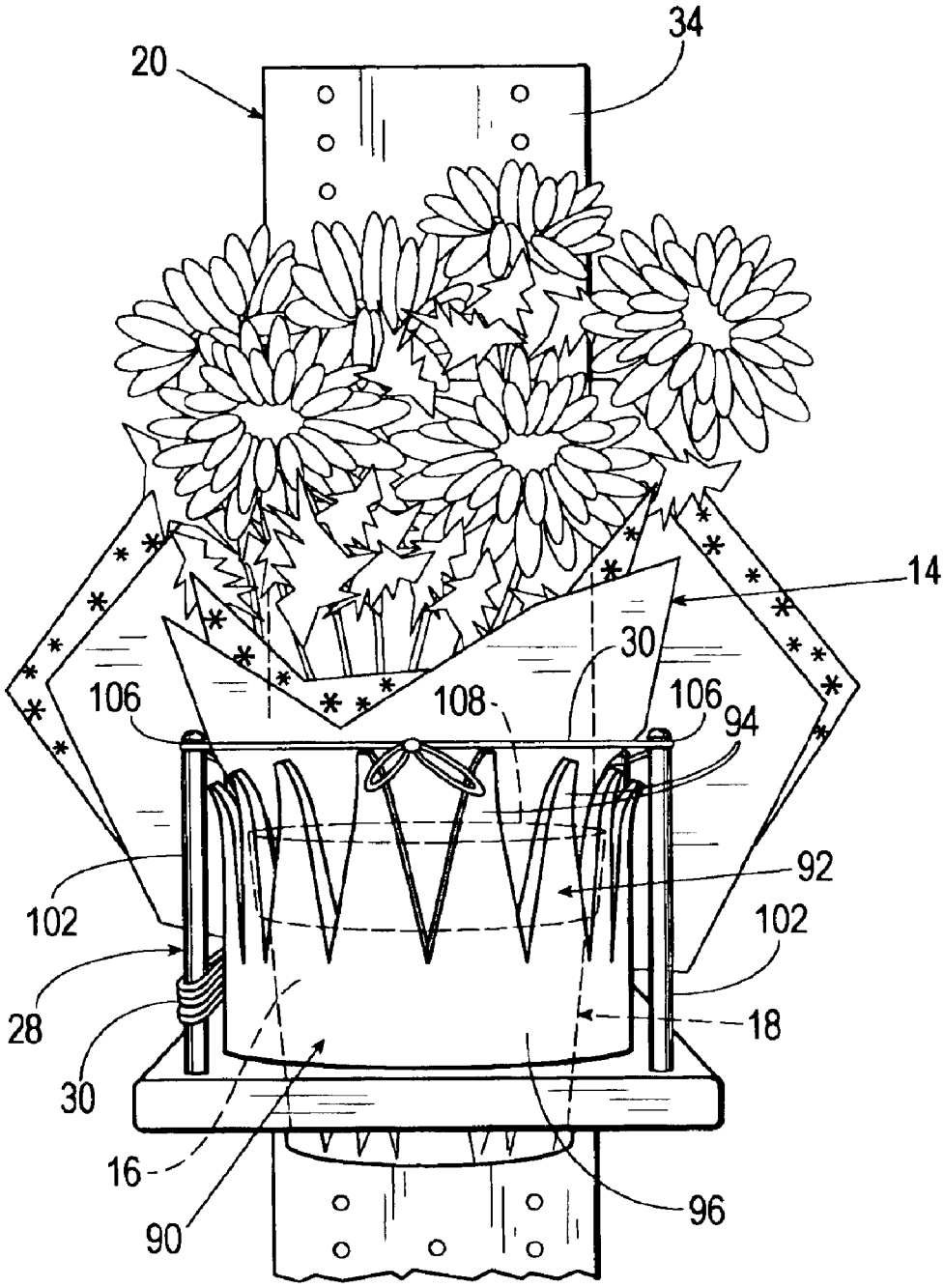
FIG. 8 is a perspective view of the decorative pleated cover formed about the outer peripheral surface of the flower pot prior to positioning a band about the decorative pleated cover.

As previously stated, the pleating assembly 24 is supported on the upper surface 26 of the platform 22 such that the pleating assembly 24 extends upwardly from the upper surface 26 of the platform 22. As more clearly shown in FIGS. 1, 2, 7 and 8, the pleating assembly 24 is provided with a lower portion 90 and an upper portion 92. The upper portion 92 includes a plurality of spatially disposed pleat forming members 94 positioned about the perimeter 96 of the lower portion 90 such that the pleat forming members 94 extend in an upwardly direction therefrom. Thus, the pleat forming members 94 of the upper portion 92 cooperate with the lower portion 90 of a pleating assembly 24 to define a pot receiving opening 98 (FIG. 4) which is sized and configured to receive at least a lower portion of the flower pot 18 and a portion of the cover forming material 76 (FIG. 8).

The pleat forming members 94, which extend upwardly from the lower portion 90 of the pleating assembly 24, are outwardly curved to facilitate positioning of the flower pot 18 and the cover forming material 76 in the pot receiving opening 98 of the pleating assembly 24. Because the pleat forming members 94 are spatially disposed relative to one another, a space 100 is provided between adjacently disposed pleat forming members 94 which assists in formation of pleats of the decorative pleated cover 14.

In order to secure the decorative pleated cover 14 so formed about the outer peripheral surfaces 16 of the flower pot 18, the apparatus 10 further includes the banding assembly 28 which is supported on the upper surface 26 of the platform 22 so as to be disposed about the pleating assembly 24. The banding assembly 28, which supports at least one band 30 thereon and desirably a plurality of bands 30, includes four elongated posts 102 extending upwardly from the upper surface 26 of the platform 22. The four elongated posts 102 are positioned on the platform 22 substantially as shown to facilitate positioning of at least one band 30 about the decorative pleated cover 14 as described in more detail herein after.

Each of the elongated posts 102 is provided with a length greater than the height of the pleating assembly 24. Further, a distal end portion 104 of each of the elongated posts 102 is provided with a band engaging portion 106 for stabilizing at least one of the bands 30 thereon and for positioning the band 30 in a banding position. Thus, upon forming the decorative pleated cover 14 about the outer peripheral surface 16 of the flower pot 18 by positioning the flower pot 18 and the cover forming material 76 within the pot receiving opening 98 of the pleating assembly 24, the decorative pleated cover 14 so formed is secured about the outer peripheral surface 16 of the flower pot 18 by removing at least one band 30 from the band engaging portion 106 of the elongated posts 102 of the banding assembly 28 and positioning the band 30 about the decorative pleated cover 14 while the flower pot 18 having the decorative pleated cover 14 disposed thereabout is supported within the pot receiving opening 98 of the pleating assembly 24. It should be noted that the band 30 can be positioned about the decorative pleated cover 14 at a position above an upper end 108 of the flower pot 18 substantially as shown in FIG. 9; or the band 30 can be positioned about the decorative pleated cover 14 at a position below the upper end 108 of the flower pot 18 substantially as shown in FIG. 10.

The term "band" is used herein means any material which may be used to secure the decorative pleated cover 14 about the flower pot 18. Thus, the term "band" includes elastic or rubber bands, as well as other types of materials such as string, a non-elastic material, a ribbon, a paper strip, a plastic strip, wire, a tie wrap or twist tie, a stribbon, a strip of heat shrinkable material or any other devise capable of securing the decorative pleated cover 14 about the flower pot 18 substantially as shown in FIGS. 9 and 10. The term "band" may also include a bow or other decorative components.

Referring now to FIG. 4, the platform 22 is provided with an opening 110 therein which is in open communication with the pot receiving opening 98 of the pleating assembly 24. The opening 110 is sized to receive a lower portion of the flower pot 18 and support the flower pot 18 while the decorative pleated cover 14 is formed thereabout, and while the band 30 is positioned about the decorative pleated cover 14 substantially as shown in FIG. 8. The opening 110 provided in the platform 22, which has a diameter less than the diameter of the portion of the pot receiving opening 98 defined by the lower portion 90 of the pleating assembly 24, is provided with a plurality of scalloped shaped portions 112 formed about the perimeter of the opening 110. Each of the scalloped shaped portions 112 is substantially aligned with one of the spaces 100 provided between adjacently disposed pleat forming members 94 of the pleating assembly 24. Thus, the scalloped shaped portions 112 formed about the opening 110 in the platform 22 cooperate with the spaces 100 provided between the pleat forming members 94 in the upper portion 92 of the pleating assembly 24 to form the pleats of the decorative pleated cover 14.

Figure 5:
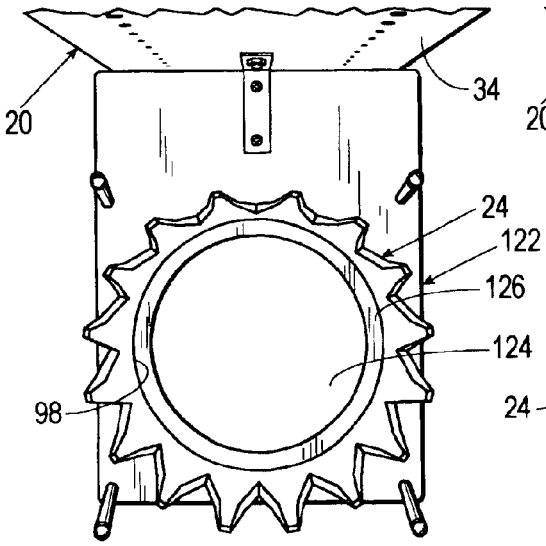
FIG. 5 is a top perspective view of another embodiment of a platform connected to the frame assembly, the platform having the pleating assembly supported on an upper surface of the platform.

Referring now to FIG. 5, shown therein is another embodiment of a platform 122 for use with the frame assembly 20. The platform 122 is connected to upright member 34 of the frame assembly 20 in the same manner as the platform 22 is connected to the frame assembly 20. The platform 122 is similar in construction to the platform 22 except an opening 124 in the platform 122 is provided with a recessed ledge 126 about the opening 124 so that an insert (not shown) can be supported on the recessed ledge 126 for assisting in the formation of pleats in the decorative pleated cover 14. The opening 124 of the platform 122 is sized such that only a lower portion of a flower pot, such as the flower pot 18, can be disposed through the opening 124.

Figure 6:
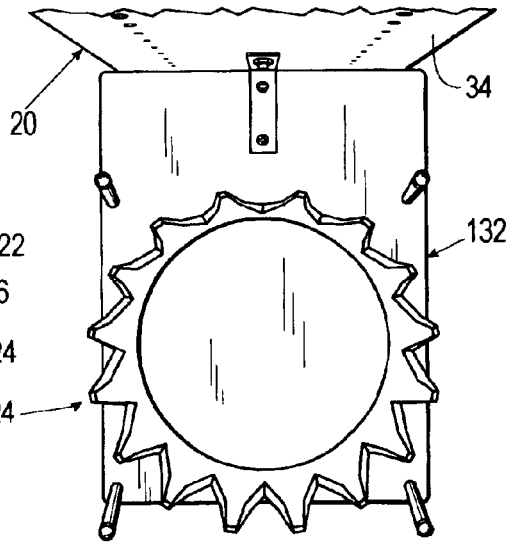
FIG. 6 is a top perspective view of yet another embodiment of a platform connected to the frame assembly, the platform having the pleating assembly supported on an upper surface of the platform.

Referring now to FIG. 6, as shown therein is yet another embodiment of a platform 132 for use with the frame assembly 20. The platform 132 is connected to the upright member 34 of the frame assembly 20 in the same manner as the platform 22 is connected to the frame assembly 20. In this embodiment, the platform 132 forms a base or lower support surface for the pleating assembly 24. Thus, upon inserting the cover forming material 76 and the flower pot 18 into the pleat forming assembly 24, a lower end or bottom 134 of the flower pot 18 (FIG. 7) is supported on the platform 132.

Referring now to FIGS. 7 and 8, the formation of the decorative pleated cover 14 about the outer peripheral surface 16 of the flower pot 18 of FIG. 9 will now be described. A plurality of sleeves 140, which constitutes the cover forming material 76, are supported on the upright member 34 of the frame assembly 20 via the hooks 72 and 74 such that the sleeves 140 are positioned above the platform 22.

To form the decorative pleated cover 14 about the flower pot 18, one or more of the sleeves 140 may be disposed within the pot receiving opening 98 of the pleating assembly 24 prior to positioning the flower pot 18 into the sleeve 140 or the flower pot 18 can be positioned in the sleeve 140 and thereafter the flower pot 18 having the sleeve 140 disposed thereabout is inserted into the pot receiving opening 98 of the pleating assembly 24 whereby the decorative pleated cover 14 is formed about the outer peripheral surface 16 of the flower pot 18. As previously stated, the spaces 100 between the pleat forming members 94 of the upper portion 92 of the pleating assembly 24, in combination with the scalloped portion 122 formed around the opening 110 of the platform 22 (FIG. 4), cooperate in forming controlled pleats within the decorative pleated cover 14.

It should be noted that when the extension 78 is provided on the sleeves 140, the apertures 82 and 83 provided in the extension 78 permit the sleeves 140 to be supported on the hooks 72 and 74 so that the sleeves 140 are secured on the upright member 34 of the frame assembly 20 substantially as shown. When it is desirable to remove one or more of the sleeves 140 from the hooks 72, 74, one can remove one or more of the sleeves 140 from the extension 78 via the perforations 84 while the sleeves 140 are supported on the hooks 72, 74; or one can remove the extension after the sleeve 140 is formed into the decorative pleated cover 14. Once the sleeve 140 is disposed about the outer peripheral surface 16 of the flower pot 18, and the sleeve and flower pot 18 are supported within the pot receiving opening 98 of the pleating assembly 24 and the opening 110 of the platform 22, one or more bands 30 can be removed from the banding assembly 28 and positioned about the decorative pleated cover 14 as shown in FIGS. 9 and 10.

In the construction of the decorative pleated cover 14 it is desirable that at least one band 30 is positioned on the band engaging portion 106 near the distal end portion 104 of each of the posts 102 of the banding assembly 28. Desirably, the band 30 is positioned on the band engaging portion 106 of each of the posts 102 prior to insertion of the sleeve 140 and the flower pot 18 into the pot receiving opening 98 of the pleating assembly 24.

Once the decorative pleated cover 14 is formed about the outer peripheral surface 16 of the flower pot 18, the band 30 is positioned about the decorative pleated cover 14 either at a position above the open upper end 118 of the flower pot 18 substantially as shown in FIG. 9, or about a portion of the decorative pleated cover 14 extending about the outer peripheral surface 16 of the flower pot 18 substantially as shown in FIG. 10. Thereafter, the flower pot 18 having the decorative pleated cover 14 disposed thereabout is removed from the pleating assembly 24.

The cover forming material 76 has been shown in the drawings as being one or more sleeves 140. However, any material capable of forming the decorative pleated cover 14 about a flower pot 18 may be used as the cover forming material 76 in the practice of the present invention.

Changes may be made in the construction and the operation of the various components, elements and assemblies described herein and changes may be made in the steps or the sequence of steps of the methods described herein without departing from the spirit and scope of the invention as defined in the following claims.

What is claimed is:

1. An apparatus for forming and securing a decorative pleated cover about an outer peripheral surface of a pot, the apparatus comprising:

a frame assembly comprising a base and an upright member supported by the base;

a platform adjustably connected to the frame assembly such that the distance between the platform and the base of the frame assembly can be varied, the platform extending outwardly from the frame assembly;

a pleating assembly supported on the platform, the pleating assembly defining a pot receiving opening sized and configured to receive at least a portion of a cover forming material and at least a lower portion of a pot; and a banding assembly connected to the platform, the banding assembly supporting at least one band thereon such that upon forming a decorative pleated cover about the pot by positioning the pot and at least a portion of the cover forming material within the pot receiving opening of the pleating assembly, the decorative pleated cover so formed is secured about the pot by removing at least one band from the banding assembly and positioning at least one band about the decorative pleated cover.

2. The apparatus of claim 1 where the platform is provided with an upper surface and wherein the pleating assembly is supported on the upper surface of the platform such that the pleating assembly extends upwardly from the upper surface of the platform.

3. The apparatus of claim 2 wherein the pleating assembly comprises:

a lower body portion having an opening formed therein, the lower body portion supported on the upper surface of the platform; and a plurality of spatially disposed pleat forming members disposed about the opening in the lower body portion and extending in an upwardly direction from the lower body portion, the plurality of spatially disposed pleat forming members cooperating with the opening in the lower body portion to define the pot receiving opening in the pleating assembly.

4. The apparatus of claim 3 wherein the banding assembly comprises a plurality of elongated posts extending from the upper surface of the platform, the elongated posts disposed about the lower body portion and the plurality of spatially disposed pleat forming members of the pleating assembly, the elongated posts having a length greater than the height of the pleating assembly such that, upon positioning a band on a distal end portion of the elongated posts, unrestricted access is provided to the pot receiving opening in the pleating assembly while permitting the band to be disposed about the decorative pleated cover while the pot having the decorative pleated cover disposed thereabout is supported within the pot receiving opening of the pleating assembly.

5. The apparatus on claim 1 wherein the platform further comprises a plurality of scalloped shaped portions formed about the perimeter of an opening in the platform, each of the scalloped shaped portions being alignable with a space provided between adjacently disposed pleat forming members of the pleating assembly for cooperating with the pleat forming members in the formation of pleats in the decorative pleated cover.

6. An apparatus for forming and securing a decorative pleated cover about an outer peripheral surface of a pot, the apparatus comprising:

a frame assembly having a base and an upright member;

a platform adjustably connected to the frame assembly such that the the distance between the platform and the base of the frame assembly can be varied;

a pleating assembly supported on an upper surface of the platform such that the pleating assembly extends upwardly from the upper surface of the platform, the pleating assembly comprising a lower body portion and a plurality of spatially disposed pleat forming member, the pleat forming members disposed about the perimeter of the lower body portion and extending in an upwardly direction therefrom, the pleat forming members cooperating with the lower body portion of the pleating assembly to define a pot receiving opening sized and configured to receive at least a lower portion of a pot; and a banding assembly connected to the platform so as to be disposed about the pleating assembly, the banding assembly supporting at least one band thereon such that upon forming a pleated decorative cover about the outer peripheral surface of the pot by positioning the pot and a cover forming a material within the pot receiving opening in the pleating assembly, the pleated decorative cover so formed is secured about the outer peripheral surface of the pot by removing at least one band from the banding assembly and positioning at least one band about the pleated decorative cover while the pot having the pleated decorative cover disposed thereabout is supported within the pot receiving opening of the pleating assembly.

7. The apparatus of claim 6 wherein the platform is provided with an opening extending there through which is aligned with the pot receiving opening defined by the pleat forming members and the lower body portion of the pleating assembly.

8. The apparatus of claim 7 wherein the platform further comprises a plurality of scalloped shaped portions formed about the perimeter of the opening in the platform, each of the scalloped shaped portions being alignable with a space provided between adjacently disposed pleat forming members of the pleating assembly for cooperating with the pleat forming members in providing pleats in the decorative pleated cover.

* * * * *